US011254337B2

(12) United States Patent
Craven et al.

(10) Patent No.: US 11,254,337 B2
(45) Date of Patent: Feb. 22, 2022

(54) DETERMINING LOCATION OF A RAIL VEHICLE BASED ON A RADIO FREQUENCY SIGNAL

(71) Applicant: Westinghouse Air Brake Technologies Corporation, Wilmerding, PA (US)

(72) Inventors: Stephen Craven, Hiawatha, IA (US); Ann K. Grimm, Cedar Rapids, IA (US); Matthew Steven Vrba, Marion, IA (US)

(73) Assignee: Westinghouse Air Brake Technologies Corporation, Wilmerding, PA (US)

( * ) Notice: Subject to any disclaimer, the term of this patent is extended or adjusted under 35 U.S.C. 154(b) by 428 days.

(21) Appl. No.: 16/219,051

(22) Filed: Dec. 13, 2018

(65) Prior Publication Data

US 2020/0189629 A1 Jun. 18, 2020

(51) Int. Cl.

*B61L 15/00* (2006.01)
*B61L 3/12* (2006.01)
*B61L 25/02* (2006.01)

(52) U.S. Cl.

CPC ..... *B61L 15/0027* (2013.01); *B61L 3/12* (2013.01); *B61L 25/025* (2013.01); *B61L 2205/04* (2013.01)

(58) Field of Classification Search

CPC ..... B61L 15/0027; B61L 3/12; B61L 25/025; B61L 2205/04

See application file for complete search history.

(56) References Cited

U.S. PATENT DOCUMENTS 5,699,986 A * 12/1997 Welk ..... B61L 29/24 246/122 R
5,902,341 A * 5/1999 Wilson ..... B61L 15/0027 246/122 R
6,179,252 B1 * 1/2001 Roop ..... B61L 29/18 246/122 R
7,196,636 B2 * 3/2007 Graham ..... B61L 29/28 246/122 R
7,315,770 B2 * 1/2008 Wade ..... B61L 29/00 246/1 R
7,769,544 B2 * 8/2010 Blesener ..... B61L 29/28 701/301
7,772,996 B2 * 8/2010 Burns ..... G08G 1/164 340/991
2013/0338901 A1 * 12/2013 Kumar ..... F02D 41/021 701/102
2014/0263857 A1 * 9/2014 Huntimer ..... B61L 29/246 246/122 R (Continued)

*Primary Examiner* — Jason C Smith
(74) *Attorney, Agent, or Firm* — The Small Patent Law Group LLC; Christopher R. Carroll

(57) ABSTRACT

A system for determining a location of a rail vehicle based on a radio frequency (RF) signal includes at least one processor programmed or configured to receive an RF signal transmitted by at least one radio transmitter device, where the RF signal includes location data associated with the location of the at least one radio transmitter device, determine a location of the at least one radio transmitter device based on the location data associated with the location of the at least one radio transmitter included in the RF signal, and determine a location of a rail vehicle based on the location of the at least one radio transmitter device. A method and computer program product are also disclosed.

20 Claims, 5 Drawing Sheets

(56) References Cited

U.S. PATENT DOCUMENTS

| | | | | |
|---|---|---|---|---|
| 2015/0302752 | A1* | 10/2015 | Holihan | B61L 23/00 246/62 |
| 2016/0010574 | A1* | 1/2016 | Kumar | B61L 3/006 701/104 |
| 2017/0043797 | A1* | 2/2017 | Allshouse | B61L 3/125 |
| 2019/0389499 | A1* | 12/2019 | Grimm | B61L 27/0005 |
| 2020/0172133 | A1* | 6/2020 | Abrosimov | B61L 25/021 |
| 2020/0189629 | A1* | 6/2020 | Craven | B61L 3/125 |
| 2020/0195426 | A1* | 6/2020 | Dreasher | H04L 63/126 |

* cited by examiner

DETERMINING LOCATION OF A RAIL VEHICLE BASED ON A RADIO FREQUENCY SIGNAL

BACKGROUND

1. Field

This disclosure relates generally to systems, devices, products, apparatus, and methods that are used for determining a location of a rail vehicle, in one particular embodiment, to a system, product, and method for determining a location of a rail vehicle based on a radio frequency (RF) signal.

2. Technical Considerations

A train control system (e.g., a train protection system) may be used to facilitate the operation of a rail vehicle (e.g., a train, a locomotive, a railroad car, a passenger car, a coach, a freight car, a wagon, and/or the like) on a track system. For example, a train control system may be used to provide for a density of rail vehicles on a track system while simultaneously maintaining separation between the rail vehicles (e.g., positive train separation) on a track (e.g., a railroad track, a train track, a set of rails, and/or the like).

A type of train control system may include a positive train control (PTC) system. In a PTC system, a rail vehicle is only allowed to move in case of a positive movement allowance. For example, the rail vehicle may be allowed to travel on a track if a command is received that allows the rail vehicle to move on the track. Otherwise, in the absence of the command, the rail vehicle may apply a braking system of the rail vehicle. In some instances, a rail vehicle that operates in a PTC system may receive information about the location of the rail vehicle and information about restrictions as to where the rail vehicle is allowed to travel (e.g., a movement authority). Equipment on board the rail vehicle may enforce the restrictions. In some instances, a rail vehicle that operates in a PTC system may require accurate information about the location of the rail vehicle in the form of a signal from a plurality of global positioning system (GPS) satellites so that the rail vehicle may use the information associated with the location of the rail vehicle to move safely.

However, a signal from one or more of the GPS satellites may be lost and the rail vehicle may be unable to obtain an accurate determination of the rail vehicle's location. For example, the rail vehicle may fail to receive the signal from one or more of the GPS satellites when the rail vehicle is traveling through a tunnel, traveling by a structure that blocks the signal from one or more of the GPS satellites, and/or the like. Without the signal from one or more of the GPS satellites, the rail vehicle may be unable to accurately determine the location of the rail vehicle.

SUMMARY

Accordingly, systems, devices, products, apparatus, and/or methods for determining a location of a rail vehicle based on a radio frequency (RF) signal are disclosed that overcome some or all of the deficiencies of the prior art.

According to another non-limiting embodiment, provided is a system for a location of a rail vehicle based on an RF signal. The system includes at least one processor programmed or configured to receive an RF signal transmitted by at least one radio transmitter device, wherein the RF signal includes location data associated with the location of the at least one radio transmitter device; determine a location of the at least one radio transmitter device based on the location data associated with the location of the at least one radio transmitter device included in the RF signal; and determine a location of a rail vehicle based on the location of the at least one radio transmitter device.

According to a non-limiting embodiment, provided is a method for determining a location of a rail vehicle based on an RF signal. The method includes receiving an RF signal transmitted by the at least one radio transmitter device, wherein the RF signal includes location data associated with the location of the at least one radio transmitter device; determining a location of the at least one radio transmitter device based on the location data associated with the location of the at least one radio transmitter device included in the RF signal; and determining a location of a rail vehicle based on the location of the at least one radio transmitter device.

According to a further non-limiting embodiment, provided is a computer program product for determining a location of a rail vehicle based on an RF signal. The computer program product comprises at least one non-transitory computer-readable medium including one or more instructions that, when executed by at least one processor, cause the at least one processor to receive an RF signal transmitted by the at least one radio transmitter device, wherein the RF signal includes location data associated with the location of the at least one radio transmitter device; determine a location of the at least one radio transmitter device based on the location data associated with the location of the at least one radio transmitter device included in the RF signal; and determine a location of a rail vehicle based on the location of the at least one radio transmitter device.

Further embodiments or aspects are set forth in the following numbered clauses:

Clause 1: A system for determining a location of a rail vehicle based on a radio frequency (RF) signal, comprising: at least one processor programmed or configured to: receive an RF signal transmitted by at least one radio transmitter device, wherein the RF signal includes location data associated with the location of the at least one radio transmitter device; determine a location of the at least one radio transmitter device based on the location data associated with the location of the at least one radio transmitter device included in the RF signal; and determine a location of a rail vehicle based on the location of the at least one radio transmitter device.

Clause 2: The system of clause 1, wherein the at least one processor is located on the rail vehicle.

Clause 3: The system of clauses 1 or 2, wherein, when determining the location of the at least one radio transmitter device, the at least one processor is programmed or configured to: determine the location of the at least one radio transmitter device based on determining that one or more satellite-based positioning system signals transmitted by one or more satellites of a satellite-based positioning system are unavailable.

Clause 4: The system of any of clauses 1-3, wherein the at least one processor is programmed or configured to: determine the location of the at least one radio transmitter device based on the location data associated with the location of the at least one radio transmitter device included in the RF signal independent of data associated with satellite-based positioning system coordinates of the rail vehicle.

Clause 5: The system of any of clauses 1-4, wherein, when determining the location of the at least one radio transmitter device, the at least one processor is programmed or configured to: determine that the one or more satellite-based positioning system signals transmitted by the one or more satellites of the one or more satellite-based positioning system signals transmitted by one or more satellites of the satellite-based positioning system are unavailable based on comparing the one or more satellite-based positioning system signals to a threshold for a satellite-based positioning system signal and determining that the one or more satellite-based positioning system signals do not satisfy the threshold for a satellite-based positioning system signal.

Clause 6: The system of any of clauses 1-5, wherein the at least one processor is further programmed or configured to: determine that the RF signal transmitted by the at least one radio transmitter device is available based on comparing the RF signal to a threshold for an RF signal and determining that the RF signal satisfies the threshold for an RF signal; and wherein, when determining the location of the at least one radio transmitter device, the at least one processor is programmed or configured to: determine the location of the at least one radio transmitter device based on determining that the RF signal satisfies the threshold for an RF signal.

Clause 7: The system of any of clauses 1-6, wherein, when receiving the RF signal transmitted by the at least one radio transmitter device, the at least one processor is programmed or configured to: receive the RF signal transmitted by the at least one radio transmitter device based on a receiver device of the rail vehicle connecting to a communication network provided by the at least one radio transmitter device.

Clause 8: A method for determining a location of a rail vehicle based on a radio frequency (RF) signal, comprising: receiving, with at least one processor, an RF signal transmitted by at least one radio transmitter device, wherein the RF signal includes location data associated with the location of the at least one radio transmitter device; determining, with the at least one processor, a location of the at least one radio transmitter device based on the location data associated with the location of the at least one radio transmitter device included in the RF signal; and determining, with the at least one processor, a location of a rail vehicle based on the location of the at least one radio transmitter device.

Clause 9: The method of clause 8, wherein the at least one processor is located on the rail vehicle.

Clause 10: The method of clauses 8 or 9, wherein determining the location of the at least one radio transmitter device comprises: determining the location of the at least one radio transmitter device based on determining that one or more satellite-based positioning system signals transmitted by one or more satellites of a satellite-based positioning system are unavailable.

Clause 11: The method of any of clauses 8-10, wherein determining the location of the at least one radio transmitter device comprises: determining the location of the at least one radio transmitter device based on the location data associated with the location of the at least one radio transmitter device included in the RF signal independent of data associated with satellite-based positioning system coordinates of the rail vehicle.

Clause 12: The method of any of clauses 8-11, further comprising: determining that the one or more satellite-based positioning system signals transmitted by the satellite-based positioning system are unavailable based on comparing the one or more satellite-based positioning system signals to a threshold for a satellite-based positioning system signal and determining that the one or more satellite-based positioning system signals do not satisfy the threshold for a satellite-based positioning system signal.

Clause 13: The method of any of clauses 8-12, wherein the at least one processor is further programmed or configured to: determine that the RF signal transmitted by the at least one radio transmitter device is available based on comparing the RF signal to a threshold for an RF signal and determining that the RF signal satisfies the threshold for an RF signal; and wherein, when determining the location of the at least one radio transmitter device, the at least one processor is programmed or configured to: determine the location of the at least one radio transmitter device based on determining that the RF signal satisfies the threshold for an RF signal.

Clause 14: The method of any of clauses 8-13, wherein receiving the RF signal transmitted by the at least one radio transmitter device comprises: receiving the RF signal transmitted by the at least one radio transmitter device based on a receiver device of the rail vehicle connecting to a communication network provided by the at least one radio transmitter device.

Clause 15: A computer program product for determining a location of a rail vehicle based on a radio frequency (RF) signal, the computer program product comprising at least one non-transitory computer-readable medium including one or more instructions that, when executed by at least one processor, cause the at least one processor to: receive an RF signal transmitted by the at least one radio transmitter device, wherein the RF signal includes location data associated with the location of the at least one radio transmitter device; determine a location of the at least one radio transmitter device based on the location data associated with the location of the at least one radio transmitter device included in the RF signal; and determine a location of a rail vehicle based on the location of the at least one radio transmitter device.

Clause 16: The computer program product of clause 15, wherein the one or more instructions that cause the at least one processor to determine the location of the at least one radio transmitter device, cause the at least one processor to: determine the location of the at least one radio transmitter device based on determining that one or more satellite-based positioning system signals transmitted by one or more satellites of a satellite-based positioning system are unavailable.

Clause 17: The computer program product of clauses 15 or 16, wherein the one or more instructions that cause the at least one processor to determine the location of the at least one radio transmitter device, cause the at least one processor to: determine the location of the at least one radio transmitter device based on the location data associated with the location of the at least one radio transmitter device included in the RF signal independent of data associated with satellite-based positioning system coordinates of the rail vehicle.

Clause 18: The computer program product of any of clauses 15-17, wherein the one or more instructions further cause the at least one processor to: determine that the one or more satellite-based positioning system signals transmitted by the one or more satellites of the satellite-based positioning system are unavailable based on comparing the one or more satellite-based positioning system signals to a threshold for a satellite-based positioning system signal and determining that the one or more satellite-based positioning system signals do not satisfy the threshold for a satellite-based positioning system signal.

Clause 19: The computer program product of any of clauses 15-18, wherein the one or more instructions further cause the at least one processor to: determine that the RF signal transmitted by the at least one radio transmitter device is available based on comparing the RF signal to a threshold for an RF signal and determining that the RF signal satisfies the threshold for an RF signal; and wherein, the one or more instructions that cause the at least one processor to determine the location of the at least one radio transmitter device, cause the at least one processor to: determine the location of the at least one radio transmitter device based on determining that the RF signal satisfies the threshold for an RF signal.

Clause 20: The computer program product of any of clauses 15-19, wherein the one or more instructions that cause the at least one processor to receive the RF signal transmitted by the at least one radio transmitter device, cause the at least one processor to: receive the RF signal transmitted by the at least one radio transmitter device based on a receiver device of the rail vehicle connecting to a communication network provided by the at least one radio transmitter device.

DETAILED DESCRIPTION

Figure 1:
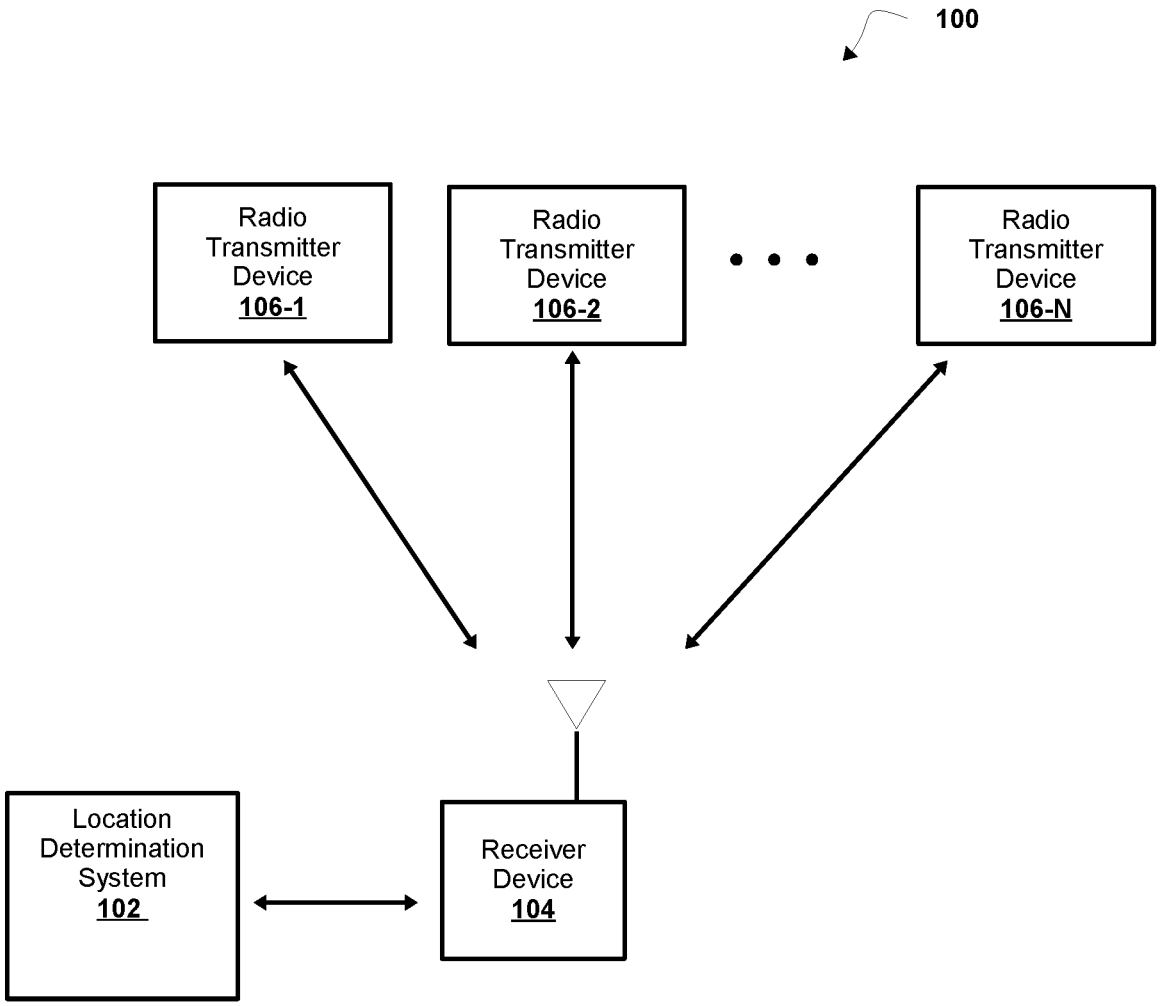
FIG. 1 is a diagram of a non-limiting embodiment of an environment in which systems, apparatus, products, and/or methods, described herein, may be implemented.

The following detailed description of non-limiting embodiments refers to the accompanying drawings. The same reference numbers in different drawings may identify the same or similar elements.

For purposes of the description hereinafter, the terms "end," "upper," "lower," "right," "left," "vertical," "horizontal," "top," "bottom," "lateral," "longitudinal," and derivatives thereof shall relate to the invention as it is oriented in the drawing figures. However, it is to be understood that the invention may assume various alternative variations and step sequences, except where expressly specified to the contrary. It is also to be understood that the specific devices and processes illustrated in the attached drawings, and described in the following specification, are simply exemplary embodiments or aspects of the invention. Hence, specific dimensions and other physical characteristics related to the embodiments or aspects of the embodiments disclosed herein are not to be considered as limiting unless otherwise indicated.

No aspect, component, element, structure, act, step, function, instruction, and/or the like used herein should be construed as critical or essential unless explicitly described as such. Also, as used herein, the articles "a" and "an" are intended to include one or more items, and may be used interchangeably with "one or more" and "at least one." Furthermore, as used herein, the term "set" is intended to include one or more items (e.g., related items, unrelated items, a combination of related and unrelated items, etc.) and may be used interchangeably with "one or more" or "at least one." Where only one item is intended, the term "one" or similar language is used. Also, as used herein, the terms "has," "have," "having," or the like are intended to be open-ended terms. Further, the phrase "based on" is intended to mean "based at least partially on" unless explicitly stated otherwise.

As used herein, the terms "communication" and "communicate" may refer to the reception, receipt, transmission, transfer, provision, and/or the like of information (e.g., data, signals, messages, instructions, commands, and/or the like). For one unit (e.g., a device, a system, a component of a device or system, combinations thereof, and/or the like) to be in communication with another unit, means that the one unit is able to directly or indirectly receive information from and/or transmit information to the other unit. This may refer to a direct or indirect connection that is wired and/or wireless in nature. Additionally, two units may be in communication with each other even though the information transmitted may be modified, processed, relayed, and/or routed between the first and second unit. For example, a first unit may be in communication with a second unit even though the first unit passively receives information and does not actively transmit information to the second unit. As another example, a first unit may be in communication with a second unit if at least one intermediary unit (e.g., a third unit located between the first unit and the second unit) processes information received from the first unit and communicates the processed information to the second unit. In some non-limiting embodiments, a message may refer to a network packet (e.g., a data packet and/or the like) that includes data. It will be appreciated that numerous other arrangements are possible.

As disclosed herein, in some non-limiting embodiments, a system for determining a location of a rail vehicle based on a radio frequency (RF) signal, includes at least one processor programmed or configured to receive an RF signal transmitted by the at least one radio transmitter device, wherein the RF signal includes location data associated with the location of the at least one radio transmitter device, determine a location of the at least one radio transmitter device based on the location data associated with the location of the at least one radio transmitter device included in the RF signal, and determine a location of a rail vehicle based on the location of the at least one radio transmitter device. In some non-limiting embodiments, the system may determine the location of the at least one radio transmitter device based on determining that one or more satellite-based positioning system signals transmitted by one or more satellites of a satellite-based positioning system are unavailable. Additionally or alternatively, the system may determine the location of the at least one radio transmitter device based on the location data associated with the location of the at least one radio transmitter device included in the RF signal independent of data associated with satellite-based positioning system coordinates of the rail vehicle.

In this way, the system may be able to obtain an accurate determination of the rail vehicle's location when one or more signals from one or more satellites of a satellite-based positioning system is lost (e.g., unavailable). For example, the system may be able to obtain an accurate determination of the rail vehicle's location when the rail vehicle is traveling through a tunnel, traveling by a structure that blocks the signal, and/or the like.

Referring now to FIG. 1, FIG. 1 is a diagram of a non-limiting embodiment of an environment 100 in which systems, apparatus, products, and/or methods, described herein, may be implemented. As shown in FIG. 1, environment 100 includes location determination system 102, receiver device 104, and one or more radio transmitter devices 106. Systems and/or devices of environment 100 may interconnect via wired connections, wireless connections, or a combination of wired and wireless connections. For example, systems and/or devices of environment 100 may interconnect via one or more wired and/or wireless networks, where the one or more wired and/or wireless networks may include, a bus, a bus network, a local area network (LAN), a wireless LAN (WLAN), a private network, an ad hoc network, an intranet, the Internet, a fiber optic-based network, a cloud computing network, and/or the like, and/or a combination of these or other types of networks.

In some non-limiting embodiments, location determination system 102 includes one or more devices capable of receiving information from receiver device 104, storing the information, determining a location of a rail vehicle based on the information, and/or communicating information to another device. For example, location determination system 102 may include one or more computing devices, such as a server, a group of servers, and/or the like. In some non-limiting embodiments, location determination system 102 may be a component of a positive train control (PTC) system. For example, location determination system 102 may be a component of a locomotive segment of a PTC system, a back office segment of a PTC system, and/or the like. In some non-limiting embodiments, location determination system 102 may include receiver device 104.

In some non-limiting embodiments, receiver device 104 includes one or more devices capable of receiving information transmitted by radio transmitter devices 106-1 through 106-N (hereinafter referred to collectively as "radio transmitter devices 106" and individually as "radio transmitter device 106"). For example, receiver device 104 may include one or more radio receivers, one or more satellite-based positioning system receivers (e.g., one or more global positioning system (GPS) receivers, one or more global navigation satellite system (GNSS) receivers, and/or the like), one or more communication receivers, one or more transceivers, one or more computing devices (e.g., one or more computers, one or more laptop computers, one or more mobile devices, and/or the like), one or more modems (e.g., one or more cellular modems), and/or the like. In some non-limiting embodiments, receiver device 104 includes one or more devices capable of connecting to a communication network provided by one or more radio transmitter devices 106.

In some non-limiting embodiments, radio transmitter device 106 includes one or more devices capable of transmitting information to receiver device 104. For example, radio transmitter device 106 may include one or more radio transmitters, one or more transceivers, one or more access points (e.g., one or more wireless access points), one or more base stations, and/or the like. In some non-limiting embodiments, radio transmitter devices 106 may include a plurality of radio transmitter devices that are all the same type of radio transmitter device. In some non-limiting embodiments, radio transmitter devices 106 may include a plurality of radio transmitter devices that are not all the same type of radio transmitter device. For example, a first radio transmitter device 106 of radio transmitter devices 106 may be a type of radio transmitter device that is different than a type of radio transmitter device of a second radio transmitter device 106.

The number and arrangement of systems shown in FIG. 1 are provided as an example. There may be additional systems, devices and/or networks, fewer systems, devices, and/or networks, different systems, devices and/or networks, or differently arranged systems, devices, and/or networks than those shown in FIG. 1. Furthermore, two or more systems or devices shown in FIG. 1 may be implemented within a single system or a single device, or a single system or a single device shown in FIG. 1 may be implemented as multiple, distributed systems or devices. Additionally or alternatively, a set of systems or a set of devices (e.g., one or more systems, one or more devices) of environment 100 perform one or more functions described as being performed by another set of systems or another set of devices of environment 100.

Figure 2:
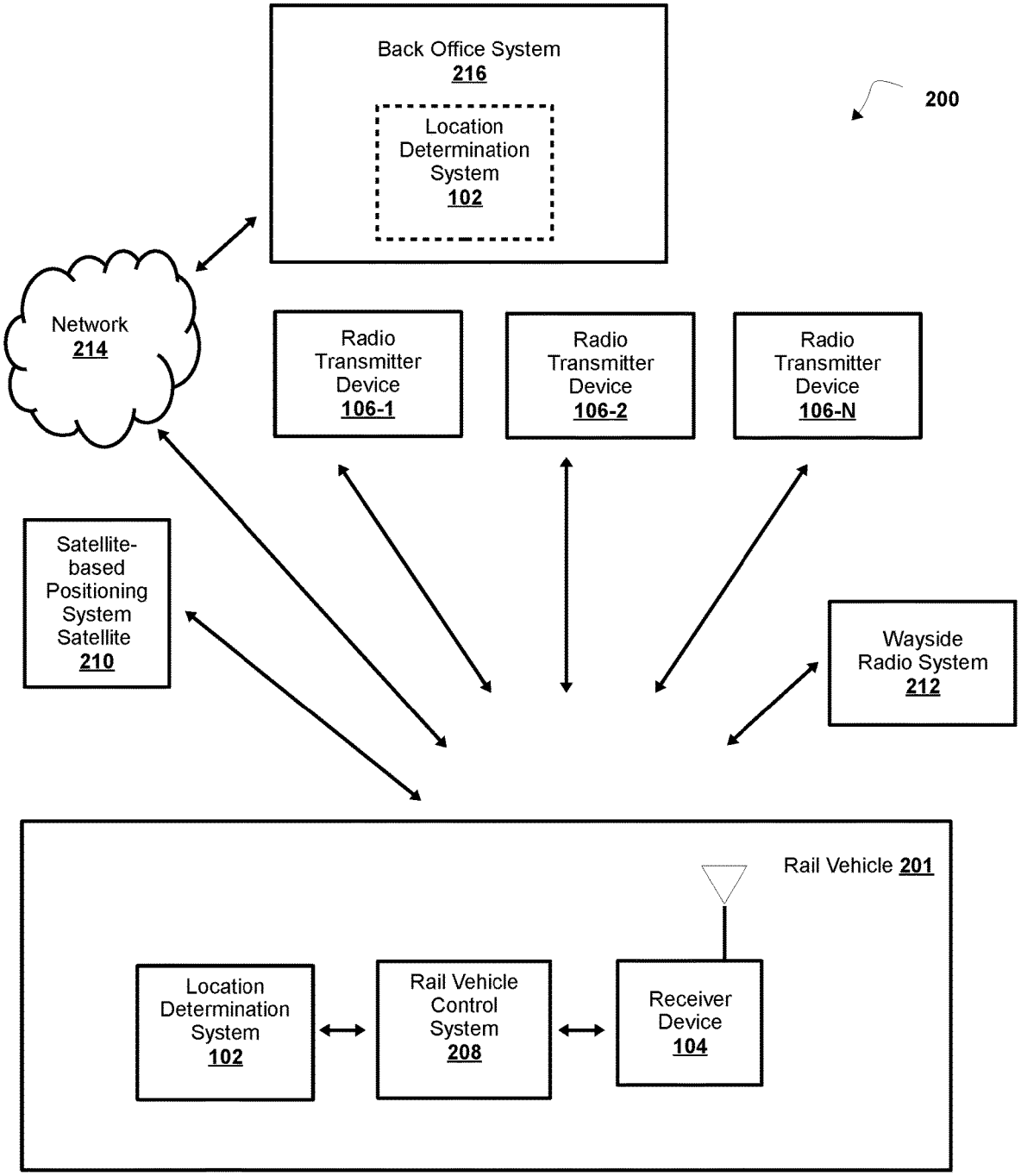
FIG. 2 is a diagram of a non-limiting embodiment of a positive train control (PTC) system for determining a location of a rail vehicle based on a global positioning system (RF) signal.

Referring now to FIG. 2, FIG. 2 is a diagram of a non-limiting embodiment of a PTC system 200 for determining a location of a rail vehicle based on an RF signal. As shown in FIG. 2, a rail vehicle 201 may include rail vehicle control system 208 and receiver device 104. As further shown in FIG. 2, rail vehicle control system 208 includes location determination system 102. In some non-limiting embodiments, location determination system 102 may be separate from rail vehicle control system 208. For example, location determination system 102 may include a device that communicates with rail vehicle control system 208 via a network (e.g., a wired or wireless network). In another example, location determination system 102 may be a component of a system that communicates with rail vehicle control system 208, such as back office system 216.

In some non-limiting embodiments, rail vehicle control system 208 may receive telemetry information (e.g., location information, GPS location information, GNSS location information, and/or the like) associated with rail vehicle 201. For example, rail vehicle control system 208 may receive telemetry information associated with rail vehicle 201 from one or more radio transmitter devices 106, satellite-based positioning system satellite 210, and/or wayside radio system 212. In some non-limiting embodiments, rail vehicle control system 208 may affect the operation of rail vehicle 201 based on the telemetry information. For example, rail vehicle control system 208 may cause a brake system of the rail vehicle to be activated based on the telemetry information. In some non-limiting embodiments, satellite-based positioning system satellite 210 may be associated with a satellite-based positioning system, such as a GPS, a GNSS, and/or the like.

In some non-limiting embodiments, rail vehicle control system 208 may receive an RF signal from one or more radio transmitter devices 106 via receiver device 104. In some non-limiting embodiments, rail vehicle control system 208 may provide the RF signal and/or location data associated with a location of one or more radio transmitter devices 106 (e.g., location data associated with a location of one or more radio transmitter devices 106 included in the RF signal) to location determination system 102. Location determination system 102 may determine a location of rail vehicle 201 and location determination system 102 may provide location data associated with the location of rail vehicle 201 to rail vehicle control system 208. Rail vehicle control system 208 may take an action based on the location of rail vehicle 201. For example, rail vehicle control system 208 may cause a brake system to be activated or deactivated based on the location of rail vehicle 201. In some non-limiting embodiments, location determination system 102 may be a component of rail vehicle control system 208.

In some non-limiting embodiments, rail vehicle control system 208 may store location data associated with a location of rail vehicle 201. For example, rail vehicle control system 208 may store a location of rail vehicle 201 in a memory associated with rail vehicle control system 208. In some non-limiting embodiments, rail vehicle control system 208 may communicate data to back office system 216. For example, rail vehicle control system 208 may communicate location data associated with a location of one or more radio transmitter devices 106 and/or location data associated with the location of rail vehicle 201 to back office system 216 via network 214.

In some non-limiting embodiments, network 214 may include one or more wired and/or wireless networks. For example, network 214 may include an interoperable train control messaging (ITCM) network, a cellular network (e.g., a long-term evolution (LTE) network, a third generation (3G) network, a fourth generation (4G) network, a code division multiple access (CDMA) network, etc.), a public land mobile network (PLMN), a local area network (LAN), a wide area network (WAN), a metropolitan area network (MAN), a telephone network (e.g., the public switched telephone network (PSTN)), a private network, an ad hoc network, an intranet, the Internet, a fiber optic-based network, a cloud computing network, and/or the like, and/or a combination of these or other types of networks.

Figure 3:
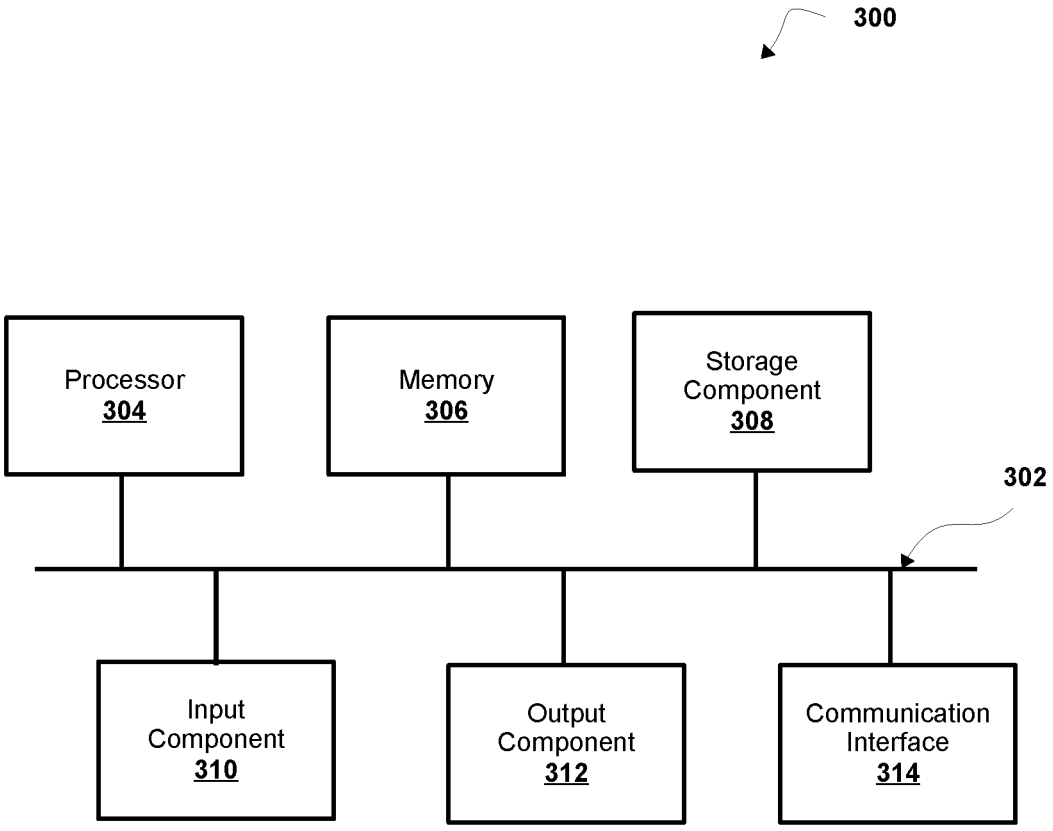
FIG. 3 is a diagram of a non-limiting embodiment of components of one or more devices of FIG. 1 and/or FIG. 2.

Referring now to FIG. 3, FIG. 3 is a diagram of example components of a device 300. In some non-limiting embodiments, device 300 corresponds to one or more devices of devices and/or systems shown in FIG. 1 and FIG. 2. For example, device 300 corresponds to one or more devices of location determination system 102 and/or one or more devices of rail vehicle control system 208. In some non-limiting embodiments, one or more devices of location determination system 102 and/or one or more devices of rail vehicle control system 208 may include at least one device 300 and/or at least one component of device 300. As shown in FIG. 3, device 300 may include bus 302, processor 304, memory 306, storage component 308, input component 310, output component 312, and communication interface 314.

Bus 302 may include a component that permits communication among the components of device 300. In some non-limiting embodiments, processor 304 may be implemented in hardware, firmware, or a combination of hardware and software. For example, processor 304 may include a processor (e.g., a central processing unit (CPU), a graphics processing unit (GPU), an accelerated processing unit (APU), etc.), a microprocessor, a digital signal processor (DSP), and/or any processing component (e.g., a field-programmable gate array (FPGA), an application-specific integrated circuit (ASIC), etc.) that can be programmed to perform a function. Memory 306 may include a random access memory (RAM), a read only memory (ROM), and/or another type of dynamic or static storage device (e.g., flash memory, magnetic memory, optical memory, etc.) that stores information and/or instructions for use by processor 304.

Storage component 308 may store information and/or software related to the operation and use of device 300. For example, storage component 308 may include a hard disk (e.g., a magnetic disk, an optical disk, a magneto-optic disk, a solid state disk, etc.), a compact disc (CD), a digital versatile disc (DVD), a floppy disk, a cartridge, a magnetic tape, and/or another type of computer-readable medium, along with a corresponding drive.

Input component 310 may include a component that permits device 300 to receive information, such as via user input (e.g., a touch screen display, a keyboard, a keypad, a mouse, a button, a switch, a microphone, etc.). Additionally or alternatively, input component 310 may include a sensor for sensing information (e.g., a GPS component, an accelerometer, a gyroscope, an actuator, etc.). Output component 312 may include a component that provides output information from device 300 (e.g., a display, a speaker, one or more light-emitting diodes (LEDs), etc.).

Communication interface 314 may include a transceiver-like component (e.g., a transceiver, a separate receiver and transmitter, etc.) that enables device 300 to communicate with other devices, such as via a wired connection, a wireless connection, or a combination of wired and wireless connections. Communication interface 314 permits device 300 to receive information from another device and/or provide information to another device. For example, communication interface 314 may include an Ethernet interface, an optical interface, a coaxial interface, an infrared interface, an RF interface, a universal serial bus (USB) interface, a Wi-Fi interface, a cellular network interface, and/or the like.

In some non-limiting embodiments, device 300 performs one or more processes described herein. In some non-limiting embodiments, device 300 performs these processes based on processor 304 executing software instructions stored by a computer-readable medium, such as memory 306 and/or storage component 308. A computer-readable medium (e.g., a non-transitory computer-readable medium) is defined herein as a non-transitory memory device. A memory device includes memory space located inside of a single physical storage device or memory space spread across multiple physical storage devices.

Software instructions are read into memory 306 and/or storage component 308 from another computer-readable medium or from another device via communication interface 314. When executed, software instructions stored in memory 306 and/or storage component 308 cause processor 304 to perform one or more processes described herein. Additionally or alternatively, hardwired circuitry may be used in place of or in combination with software instructions to perform one or more processes described herein. Thus, embodiments described herein are not limited to any specific combination of hardware circuitry and software.

The number and arrangement of components shown in FIG. 3 are provided as an example. In some non-limiting embodiments, device 300 includes additional components, fewer components, different components, or differently arranged components than those shown in FIG. 3. Additionally or alternatively, a set of components (e.g., one or more components) of device 300 performs one or more functions described as being performed by another set of components of device 300.

Figure 4:
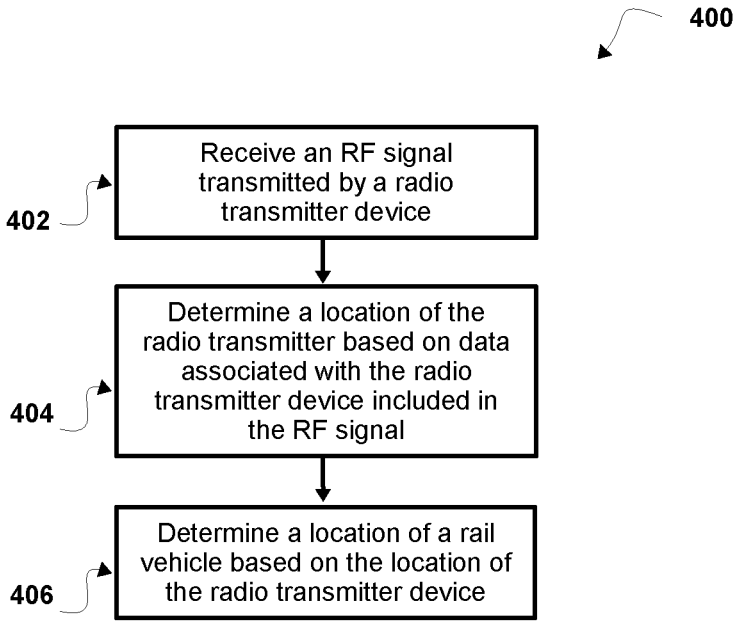
FIG. 4 is a flowchart of a non-limiting embodiment of a process for determining a location of a rail vehicle based on an RF signal.

Referring now to FIG. 4, FIG. 4 is a flowchart of a non-limiting embodiment of a process 400 for determining a location of a rail vehicle based on an RF signal. In some non-limiting embodiments, one or more of the steps of process 400 may be performed (e.g., completely, partially, etc.) by location determination system 102 (e.g., one or more devices of location determination system 102). In some non-limiting embodiments, one or more of the steps of process 400 may be performed (e.g., completely, partially, etc.) by another device or a group of devices separate from or including location determination system 102, such as an additional location determination system 102, one or more components of rail vehicle control system 208, and/or the like.

As shown in FIG. 4, at step 402, process 400 includes receiving an RF signal transmitted by a radio transmitter device. For example, location determination system 102 may receive the RF signal transmitted by radio transmitter device 106 via receiver device 104. In some non-limiting embodiments, the RF signal may be an RF signal transmitted by radio transmitter device 106 that is used to establish a connection with a rail vehicle. For example, the RF signal may be an RF signal transmitted by a radio transmitter device associated with a wireless network (e.g., a WLAN, a Wifi network, etc.), a PTC radio system (e.g., a PTC 220 Mhz radio system, a 220 MHz ITCM radio system, etc.), an ITCM system, a beacon system (e.g., a Bluetooth® beacon system, a Bluetooth Low Energy (BLE) beacon system, and/or the like), and/or the like. In some non-limiting embodiments, the RF signal may include a message, such as a broadcast message associated with an ITCM messaging system.

In some non-limiting embodiments, the RF signal may include data associated with radio transmitter device 106 that transmitted the RF signal. For example, the RF signal may include location data associated with a location of the radio transmitter device 106. In some non-limiting embodiments, the location data associated with the location of radio transmitter device 106 may include location coordinates (e.g., Cartesian coordinates, GPS coordinates, coordinates that correspond to a specific location on a track, etc.) of radio transmitter device 106.

In some non-limiting embodiments, location determination system 102 may receive the RF signal transmitted by radio transmitter device 106 via receiver device 104 based on a rail vehicle being within a radio coverage area (e.g., an antenna pattern, a radiation pattern, a beam path, etc.) of radio transmitter device 106. For example, location determination system 102 may receive the RF signal transmitted when the rail vehicle travels through the radio coverage area of radio transmitter device 106. In some non-limiting embodiments, radio transmitter device 106 may be positioned near a track so that the location of radio transmitter device 106 allows for location determination system 102 to accurately receive the RF signal transmitted by radio transmitter device 106. For example, radio transmitter device 106 may be positioned at a wayside location with regard to a track. In another example, radio transmitter device 106 may be positioned at a location that is between two tracks (e.g., in between two parallel tracks).

In some non-limiting embodiments, a plurality of radio transmitter devices 106 may be positioned near a track so that the plurality of radio transmitter devices 106 include radio coverage areas that overlap or do not overlap. For example, a first radio transmitter device 106 may be positioned a predetermined distance away from a second radio transmitter device 106 so that a radio coverage area of the first radio transmitter device 106 does not overlap a radio coverage area of the second radio transmitter device 106. In this way, location determination system 102 may be able to more accurately determine a location of radio transmitter device 106 based on an RF signal received as a rail vehicle is traveling through radio coverage areas of radio transmitter devices 106 as compared to a situation where radio coverage areas overlap. Location determination system 102 may be able to more accurately determine a location since there will be a greater time period between times at which RF signals are received based on the rail vehicle traveling through radio coverage areas of radio transmitter devices 106 in a situation that the radio coverage areas do not overlap as compared to a situation that the radio coverage areas overlap.

In some non-limiting embodiments, radio transmitter device 106 may be positioned so that a radio coverage area is directed towards a rail vehicle that is approaching radio transmitter device 106. For example, radio transmitter device 106 may be positioned so that an RF signal transmitted by radio transmitter device 106 is directed towards the front of a rail vehicle that is approaching radio transmitter device 106. In another example, radio transmitter device 106 may be positioned so that an RF signal transmitted by radio transmitter device 106 is directed towards the side of a rail vehicle that is approaching radio transmitter device 106. In such an example, the RF signal transmitted by radio transmitter device 106 may be directed perpendicularly to a track on which the rail vehicle is traveling. In some non-limiting embodiments, radio transmitter device 106 may be positioned so that a radio coverage area is directed away from a rail vehicle that is approaching radio transmitter device 106.

In some non-limiting embodiments, location determination system 102 may receive the RF signal transmitted by radio transmitter device 106 via receiver device 104 based on failing to be able to determine a location of a rail vehicle with regard to one or more satellite-based positioning system signals (e.g., one or more satellite-based positioning system signals that include satellite-based positioning system coordinates) received from satellites of a satellite-based positioning system. For example, location determination system 102 may receive the RF signal based on failing to be able to determine the location of the rail vehicle based on a threshold associated with a satellite-based positioning system. In some non-limiting embodiments, the threshold may be associated with a standard for a satellite-based positioning system, such as the national marine electronics association (NMEA) standard. For example, the threshold may be based on a fix quality, a number of satellites from which a signal is received, and/or a dilution of precision (e.g., a horizontal dilution of precision) associated with one or more signals received from one or more satellites of a satellite-based positioning system (e.g., one or more GPS system satellites, one or more GNSS system satellites, and/or the like). In some non-limiting embodiments, location determination system 102 may fail to be able to determine the location of the rail vehicle based on one or more satellite-based positioning system signals associated with a satellite-based positioning system being unavailable (e.g., based on failing to receive one or more satellite-based positioning system signals from one or more satellites of a satellite-based positioning system).

In some non-limiting embodiments, location determination system 102 may determine that one or more satellite-based positioning system signals are unavailable to (e.g., not being received by) a receiver device (e.g., receiver device 104) of a rail vehicle associated with location determination system 102 (e.g., a rail vehicle of which location determination system 102 is a component). In some non-limiting embodiments, location determination system 102 may control the receiver device and/or another receiver device (e.g., may activate the receiver device and/or another receiver device) to receive an RF signal transmitted by radio transmitter device 106 based on determining that the one or more satellite-based positioning system signals are unavailable and/or based on failing to be able to determine a location of the rail vehicle with regard to one or more satellite-based positioning system signals.

In some non-limiting embodiments, location determination system 102 may determine that one or more satellite-based positioning system signals are unavailable. For example, location determination system 102 may determine that the one or more satellite-based positioning system signals transmitted by one or more satellites of a satellite-based positioning system are not being received by receiver device 104. In another example, location determination system 102 may determine that one or more satellite-based positioning system signals transmitted by one or more satellites of the satellite-based positioning system is inaccurate (e.g., degraded, of insufficient quality, and/or the like) based on comparing the one or more satellite-based positioning system signals to a threshold (e.g., a threshold including a signal to noise ratio) associated with a satellite-based positioning system signal for a satellite-based positioning system and determining that the one or more satellite-based positioning system signals do not satisfy the threshold.

In some non-limiting embodiments, the RF signal may include data associated with radio transmitter device 106. For example, the RF signal may include location data associated with a location of radio transmitter device 106. In some non-limiting embodiments, the data included in the RF signal may include an identifier of radio transmitter device 106. For example, the data included in the RF signal may include a unique identifier, a code, a name, and/or the like, that identifies radio transmitter device 106. In some non-limiting embodiments, location determination system 102 may identify a specific radio transmitter device 106 of a plurality of radio transmitter devices 106 from other radio transmitter devices 106 in the plurality of radio transmitter devices 106 based on the identifier of radio transmitter device 106.

In some non-limiting embodiments, location determination system 102 may receive the RF signal transmitted by radio transmitter device 106 via receiver device 104 based on receiver device 104 connecting to a communication network (e.g., a wireless communication network, a Wifi network, and/or the like) provided by radio transmitter device 106. For example, location determination system 102 may connect to a communication network provided by radio transmitter device 106 and location determination system 102 may receive the RF signal transmitted by radio transmitter device 106 during a handshake to connect to the communication network provided by radio transmitter device 106. In some non-limiting embodiments, location determination system 102 may receive the RF signal transmitted by radio transmitter device 106 after connecting to the communication network provided by radio transmitter device 106.

In some non-limiting embodiments, location determination system 102 may communicate data associated with radio transmitter device 106 (e.g., identifier data associated with an identifier of radio transmitter device 106, location data associated with a location of radio transmitter device 106, and/or the like) included in the RF signal that is received by location determination system 102. For example, location determination system 102 may communicate the data associated with radio transmitter device 106 to a server (e.g., a server of back office system 216, and/or the like). In some non-limiting embodiments, location determination system 102 may receive location data associated with a location of radio transmitter device 106 from the server. For example, location determination system 102 may receive the location data associated with the location of radio transmitter device 106 based on the server determining the location of radio transmitter device 106. The server may determine the location of radio transmitter device 106 based on the data associated with radio transmitter device 106 transmitted by location determination system 102.

As further shown in FIG. 4, at step 404, process 400 includes determining a location of the radio transmitter device based on data associated with the radio transmitter device included in the RF signal. For example, location determination system 102 may determine the location of radio transmitter device 106 based on data associated with radio transmitter device 106 included in the RF signal.

In some non-limiting embodiments, location determination system 102 may determine the location of radio transmitter device 106 based on the data associated with radio transmitter device 106 included in the RF signal that is received by location determination system 102. For example, location determination system 102 may retrieve location data (e.g., location data associated with a location of radio transmitter device 106) from a data structure based on the data associated with radio transmitter device 106. In some non-limiting embodiments, the data structure may be a database stored locally and associated with location determination system 102 (e.g., a database that is stored in a system of a rail vehicle that includes location determination system 102). In some non-limiting embodiments, the data structure may be a database stored remotely from location determination system 102 (e.g., a database that is stored in back office system 216 that has a communication connection to a rail vehicle). Location determination system 102 may determine the location of radio transmitter device 106 based on the location data retrieved from the data structure. In some non-limiting embodiments, location determination system 102 may communicate location data associated with a location of radio transmitter device 106 after retrieving the location data from the data structure.

In some non-limiting embodiments, location determination system 102 may determine the location of radio transmitter device 106 based on an identifier of radio transmitter device 106 included in an RF signal. For example, location determination system 102 may receive the RF signal via receiver device 104 and the RF signal may include the identifier of radio transmitter device 106. Location determination system 102 may compare the identifier of radio transmitter device 106 included in the RF signal to a plurality of identifiers (e.g., a plurality of identifiers associated with a plurality of radio transmitter devices) stored in a data structure (e.g., a database). Location determination system 102 may determine that the identifier of radio transmitter device 106 included in the RF signal matches an identifier of the plurality of identifiers stored in the data structure and location determination system 102 may retrieve location data associated with a location of radio transmitter device 106 that is stored in an element of the data structure (e.g., where the element is associated with the identifier of the plurality of identifiers). In such an example, location determination system 102 may determine the location of radio transmitter device based on the location data stored in the data structure. In some non-limiting embodiments, location determination system 102 may determine that the identifier of radio transmitter device 106 included in the RF signal does not match an identifier of the plurality of identifiers stored in the data structure and location determination system 102 may forego determining the location of radio transmitter device 106 based on the identifier of radio transmitter device 106 included in the RF signal. Additionally, location determination system 102 may determine the location of radio transmitter device 106 based on an identifier of radio transmitter device 106 included in another RF signal.

In some non-limiting embodiments, location determination system 102 may determine the location of radio transmitter device 106 based on location data associated with the location of radio transmitter device 106 included in the RF signal independent of data associated with satellite-based positioning system coordinates (e.g., GPS coordinates, GNSS coordinates, and/or the like). For example, the RF signal may not include data associated with satellite-based positioning system coordinates of radio transmitter device 106 and/or a rail vehicle and location determination system 102 may determine the location of radio transmitter device 106 based on (e.g., based solely on) the location data associated with the location of the at least one radio transmitter included in the RF signal. In some non-limiting embodiments, location determination system 102 may determine the location of radio transmitter device 106 based on the location data associated with the location of radio transmitter device 106 included in the RF signal independent of one or more satellite-based positioning system signals associated with a satellite-based positioning system (e.g., one or more GPS signals associated with a GPS system including GPS coordinates indicating a location of a rail vehicle, one or more GNSS signals associated with a GNSS system including GNSS coordinates indicating a location of a rail vehicle, and/or the like). For example, location determination system 102 may determine that one or more signals associated with the satellite-based positioning system are unavailable. Location determination system 102 may determine the location of radio transmitter device 106 based on the location data included in the RF signal. In some non-limiting embodiments, location determination system 102 may determine the location of radio transmitter device 106 based on failing to be able to determine a location of a rail vehicle (e.g., based on determining that one or more satellite-based positioning system signals associated with a satellite-based positioning system are unavailable).

In some non-limiting embodiments, location determination system 102 may determine the location of radio transmitter device 106 based on a connection to a communication network. For example, location determination system 102 may connect to a communication network provided by radio transmitter device 106, and location determination system 102 may determine an identifier of the communication network. Location determination system 102 may determine a location of radio transmitter device 106 based on the identifier of the communication network. In some non-limiting embodiments, location determination system 102 may determine location coordinates of radio transmitter device 106 based on the identifier of the communication network. For example, location determination system 102 may retrieve location coordinates of radio transmitter device 106 from a data structure based on the identifier of the communication network.

In some non-limiting embodiments, location determination system 102 may determine the location of radio transmitter device 106 based on determining that an RF signal transmitted by radio transmitter device 106 is available. For example, location determination system 102 may determine that the RF signal transmitted by radio transmitter device 106 is available based on comparing the RF signal to a threshold for an RF signal (e.g., a signal threshold for the RF signal, a signal threshold for the RF signal including a predetermined magnitude, a signal threshold for the RF signal including a predetermined magnitude in decibels, and/or the like) and determining that the RF signal satisfies the threshold for an RF signal. Location determination system 102 may determine the location of the at least one radio transmitter device based on determining that the RF signal satisfies the threshold for an RF signal.

In some non-limiting embodiments, location determination system 102 may communicate location data associated with a location of radio transmitter device 106 based on determining the location of radio transmitter device 106. For example, location determination system 102 may communicate location data associated with the location of radio transmitter device 106 after retrieving location data stored in a data structure that is associated with an identifier of radio transmitter device 106. In some non-limiting embodiments, location determination system 102 may communicate location data associated with the location of radio transmitter device 106 to a rail vehicle.

In some non-limiting embodiments, location determination system 102 may receive location data associated with the location of radio transmitter device 106 via receiver device 104. For example, location determination system 102 may receive the location data associated with the location of radio transmitter device 106 based on a rail vehicle (e.g., rail vehicle 201) communicating the location data associated with the location of radio transmitter device 106 to location determination system 102. In such an example, location determination system 102 may be a component of a back office system (e.g., back office system 216) or location determination system 102 may be in communication with the back office system. In some non-limiting embodiments, location determination system 102 may determine the location of radio transmitter device 106 based on receiving the location data associated with the location of radio transmitter device 106 included in the RF signal.

In some non-limiting embodiments, location determination system 102 may determine the location of radio transmitter device 106 based on a connection to radio transmitter device 106. For example, location determination system 102 may connect to radio transmitter device 106 and location determination system 102 may determine an identifier of radio transmitter device 106. Location determination system 102 may determine a location of radio transmitter device 106 based on the identifier of radio transmitter device 106. In some non-limiting embodiments, location determination system 102 may determine location coordinates of radio transmitter device 106 based on the identifier of radio transmitter device 106. For example, location determination system 102 may retrieve location coordinates of radio transmitter device 106 from a data structure based on the identifier of radio transmitter device 106. In some non-limiting embodiments, location determination system 102 may determine an identifier of radio transmitter device 106 based on location determination system 102 querying a protocol stack (e.g., an ITCM protocol stack) to determine one or more radio transmitter devices 106 to which location determination system 102 is connected.

As further shown in FIG. 4, at step 406, process 400 includes determining a location of a rail vehicle based on the location of the radio transmitter device. For example, location determination system 102 may determine the location (e.g., the track location, the location on a track of a plurality of tracks, and/or the like) of the rail vehicle based on the location of radio transmitter device 106. In some non-limiting embodiments, location determination system 102 may determine that the location of the rail vehicle corresponds to the location of radio transmitter device 106. For example, location determination system 102 may determine that the location of the rail vehicle matches or is within a predetermined distance of the location of radio transmitter device 106 when the RF signal is received by location determination system 102.

In some non-limiting embodiments, location determination system 102 may determine the location of the rail vehicle based on the location data associated with the location of radio transmitter device 106 included in the RF signal independent of data associated with satellite-based positioning system coordinates (e.g., GPS coordinates, GNSS coordinates, and/or the like) of the rail vehicle. For example, the RF signal may not include data associated with satellite-based positioning system coordinates of the rail vehicle and location determination system 102 may determine the location of radio transmitter device 106 based on (e.g., based solely on) the location data associated with the location of radio transmitter device 106 included in the RF signal. In some non-limiting embodiments, location determination system 102 may determine the location of the rail vehicle based on the location data associated with the location of the at least one radio transmitter included in the RF signal independent of one or more satellite-based positioning system signals associated with a satellite-based positioning system (e.g., a GPS signal associated with a GPS system including GPS coordinates indicating a location of a rail vehicle, a GNSS signal associated with a GNSS system including GNSS coordinates indicating a location of a rail vehicle, and/or the like). For example, location determination system 102 may determine that the one or more satellite-based positioning system signals associated with the satellite-based positioning system are unavailable. Location determination system 102 may determine the location of radio transmitter device 106 based on (e.g., based solely on) the location data included in the RF signal. In some non-limiting embodiments, location determination system 102 may determine the location of the rail vehicle, based on determining that the one or more satellite-based positioning system signals associated with the satellite-based positioning system are unavailable.

In some non-limiting embodiments, location determination system 102 may determine the location of the rail vehicle using the location of radio transmitter device 106 based on determining that the location of the rail vehicle is unknown (e.g., there is not a last known track location of the rail vehicle stored in a data structure accessible by the rail vehicle). For example, location determination system 102 may determine that location data associated with a location of the rail vehicle does not satisfy a threshold. The location data associated with the location of the rail vehicle may be stored locally (e.g., stored locally in a data structure of a system or device of the rail vehicle) on the rail vehicle and/or remotely from the rail vehicle (e.g., stored remotely in a data structure of a system or device that is remote from the rail vehicle). Location determination system 102 may determine the location of the rail vehicle using the location of radio transmitter device 106 based on determining that the location data associated with the location of the rail vehicle does not satisfy the threshold.

In some non-limiting embodiments, location determination system 102 may determine the location of a rail vehicle based on receiving the data associated with radio transmitter device 106 included in the RF signal. For example, location determination system 102 may receive data associated with radio transmitter device 106 that was communicated from the rail vehicle and location determination system 102 may determine the location of the rail vehicle based on the data associated with radio transmitter device 106.

In some non-limiting embodiments, location determination system 102 may determine the location of a rail vehicle based on determining that one or more satellite-based positioning system signals associated with a satellite-based positioning system are unavailable. For example, location determination system 102 may determine the location of the rail vehicle based on the data associated with radio transmitter device 106 included in the RF signal after determining that one or more satellite-based positioning system signals are unavailable.

In some non-limiting embodiments, location determination system 102 may determine that an RF signal transmitted by a radio transmitter device 106 is available based on comparing the RF signal to a threshold for an RF signal (e.g., a threshold including a signal to noise ratio for an RF signal) and determining that the RF signal satisfies the threshold for an RF signal. In some non-limiting embodiments, location determination system 102 may determine the location of the radio transmitter device 106 based on determining that the RF signal satisfies the threshold for an RF signal.

In some non-limiting embodiments, location determination system 102 may determine the location of a rail vehicle based on data associated with a first radio transmitter device 106 of a plurality of radio transmitter devices 106 included in a plurality of RF signals. For example, location determination system 102 may receive a plurality of RF signals transmitted by a plurality of radio transmitter devices 106. Location determination system 102 may determine a ranking of the plurality of radio transmitter devices 106 based on a priority of a type of radio transmitter device (e.g., a type of radio transmitter device associated with a wireless network, a type of radio transmitter device associated with a PTC radio system, a type of radio transmitter device associated with an ITC messaging system, a type of radio transmitter device associated with a beacon system, and/or the like) associated with each of the plurality of radio transmitter devices 106. Location determination system 102 may determine that the first radio transmitter device 106 of the plurality of radio transmitter devices 106 has the highest ranking. Location determination system 102 may determine that an RF signal transmitted by the first radio transmitter device 106 of the plurality of radio transmitter devices 106 was received by location determination system 102 (e.g., received by location determination system via receiver device 104) based on determining that the first radio transmitter device 106 has the highest ranking. Location determination system 102 may determine the location of the rail vehicle based on data associated with the first radio transmitter device 106 included in the RF signal transmitted by the first radio transmitter device 106.

In some non-limiting embodiments, location determination system 102 may determine the location of a rail vehicle based on data associated with a subset of radio transmitter devices 106 of a plurality of radio transmitter devices 106 included in a plurality of RF signals. For example, location determination system 102 may receive a plurality of RF signals transmitted by a plurality of radio transmitter devices 106. Location determination system 102 may determine a type of radio transmitter device associated with each radio transmitter device 106 of the plurality of radio transmitter devices 106. Location determination system 102 may determine the subset of radio transmitter devices 106 based on the type of radio transmitter device associated with each radio transmitter device 106 of the subset of radio transmitter devices 106. In some non-limiting embodiments, location determination system 102 may determine the subset of radio transmitter devices 106 so that the subset includes a first type of radio transmitter device that is different from a second type of radio transmitter device. Referring back to the example above, location determination system 102 may determine the location of a rail vehicle based on data associated with a radio transmitter device 106 that is of a first type of radio transmitter device and location determination system 102 may determine the location of the rail vehicle based on data associated with a radio transmitter device 106 that is of a second type of radio transmitter device.

In some non-limiting embodiments, location determination system 102 may determine the location of radio transmitter device 106 based on the data associated with radio transmitter device 106 included in the RF signal and location data associated with a location of the rail vehicle received from another source of location data associated with the rail vehicle (e.g., another source of location data located on the rail vehicle). For example, location determination system 102 may determine the location of radio transmitter device 106 based on the data associated with radio transmitter device 106 and location data associated with the location of the rail vehicle received from a wheel tachometer measurement system of the rail vehicle.

In some non-limiting embodiments, location determination system 102 may determine the location of the rail vehicle based on data associated with radio transmitter device 106 and a satellite-based positioning system signal. For example, location determination system 102 may determine that one or more satellite-based positioning system signals being received are inaccurate based on a threshold. Location determination system 102 may determine the location of a rail vehicle based on the data associated with radio transmitter device 106 included in an RF signal received from radio transmitter device 106 and one or more satellite-based positioning system signals (e.g., one or more satellite-based positioning system signals determined not to be inaccurate). In some non-limiting embodiments, location determination system 102 may determine the location of the rail vehicle based on determining that the one or more satellite-based positioning system signals being received do not satisfy the threshold.

In some non-limiting embodiments, location determination system 102 may determine a distance of a rail vehicle from radio transmitter device 106. For example, location determination system 102 may determine a location of radio transmitter device 106 based on the data associated with radio transmitter device 106 included in the RF signal. Location determination system 102 may determine the distance of the rail vehicle from radio transmitter based on an amount of time from when radio transmitter device 106 communicated the RF signal and an amount of time from when location determination system 102 received the RF signal. In some non-limiting embodiments, location determination system 102 may determine a location of the rail vehicle based on the distance of the rail vehicle from the radio transmitter. For example, location determination system 102 may determine data associated with a presence of the rail vehicle on a track (e.g., data associated with an identification of a track of a plurality of tracks upon which the rail vehicle is traveling). Location determination system 102 may determine location data associated with a location of the track upon which the rail vehicle is traveling based on the data associated with the presence of the rail vehicle on the track. Location determination system 102 may determine the location of the rail vehicle based on the distance of the rail vehicle from the radio transmitter and the location data associated with a location of the track upon which the rail vehicle is traveling.

In some non-limiting embodiments, a rail vehicle may perform an action based on determining the location of the rail vehicle. For example, the rail vehicle may perform an action associated with operation of a system (e.g., a braking system) of the rail vehicle. In some non-limiting embodiments, location determination system 102 may cause the rail vehicle to perform an action associated with operation of the rail vehicle based on determining the location of the rail vehicle. For example, location determination system 102 may cause a brake system of the rail vehicle to be activated.

Figure 5:
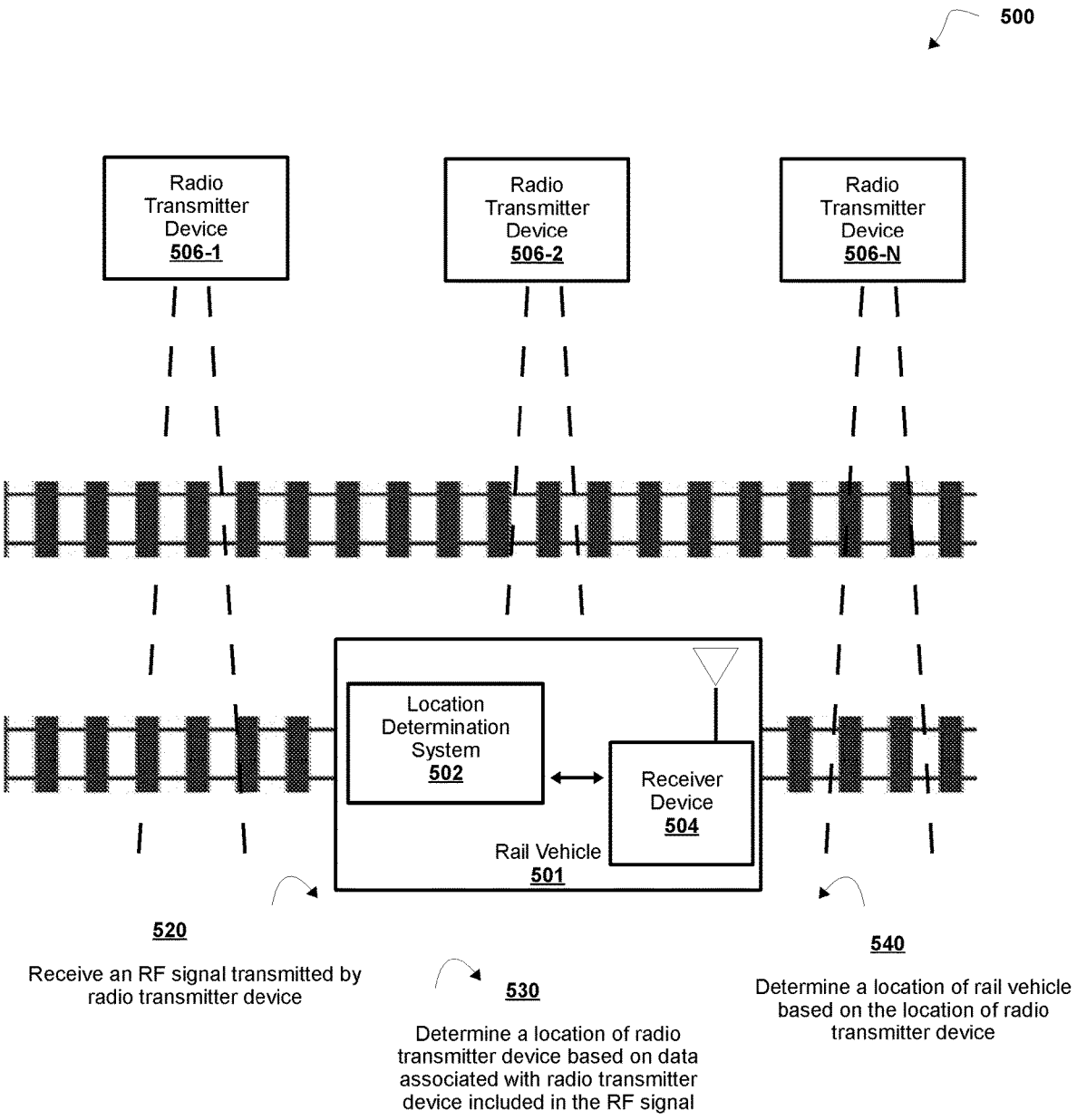
FIG. 5 is a diagram of an implementation of a non-limiting embodiment of a process disclosed herein.

Referring now to FIG. 5, FIG. 5 is a diagram of an overview of a non-limiting embodiment of an implementation 500 relating to a process for determining a location of a rail vehicle based on an RF signal. As shown in FIG. 5, implementation 500 may include rail vehicle 501 and radio transmitter devices 506-1 through 506-N. In some non-limiting embodiments, rail vehicle 501 may include location determination system 502 and receiver device 504. In some non-limiting embodiments, rail vehicle 501 may be the same or similar to rail vehicle 201, location determination system 502 may be the same or similar to location determination system 102, and receiver device 504 may be the same or similar to receiver device 104. In some non-limiting embodiments, radio transmitter devices 506-1 through 506-N may be the same or similar to radio transmitter devices 106.

As shown by reference number 520 in FIG. 5, rail vehicle 501 may travel through a radio coverage area of radio transmitter device 506-2 and location determination system 502 may receive an RF signal transmitted by radio transmitter device 506-2 via receiver device 504. For example, location determination system 502 may receive the RF signal as discussed herein. As further shown by reference number 530 in FIG. 5, location determination system 502 may determine a location of radio transmitter device 506-2 based on data associated with radio transmitter device 506-2 included in the RF signal. For example, location determination system 502 may determine the location of radio transmitter device 506-2 as discussed herein. As further shown by reference number 540 in FIG. 5, location determination system 502 may determine a location of rail vehicle 501 based on the location of radio transmitter device 506-2. For example, location determination system 502 may determine the location of rail vehicle 501 as discussed herein.

Some non-limiting embodiments are described herein in connection with thresholds. As used herein, satisfying a threshold may refer to a value being greater than the threshold, more than the threshold, higher than the threshold, greater than or equal to the threshold, less than the threshold, fewer than the threshold, lower than the threshold, less than or equal to the threshold, equal to the threshold, and/or the like.

The foregoing disclosure provides illustration and description, but is not intended to be exhaustive or to limit the implementations to the precise form disclosed. Modifications and variations are possible in light of the above disclosure or may be acquired from practice of the implementations.

It will be apparent that systems, devices, products, apparatus, and/or methods, described herein, may be implemented in different forms of hardware, firmware, or a combination of hardware and software. The actual specialized control hardware or software code used to implement these systems and/or methods is not limiting of the implementations. Thus, the operation and behavior of the systems, devices, products, apparatus, and/or methods were described herein without reference to specific software code; it being understood that software and hardware can be designed to implement the systems and/or methods based on the description herein.

Even though particular combinations of features are recited in the claims and/or disclosed in the specification, these combinations are not intended to limit the disclosure of possible implementations. In fact, many of these features may be combined in ways not specifically recited in the claims and/or disclosed in the specification. Although each dependent claim listed below may directly depend on only one claim, the disclosure of possible implementations includes each dependent claim in combination with every other claim in the claim set.

What is claimed is:

1. A system comprising:

at least one processor programmed or configured to:

receive a radio frequency (RF) signal transmitted by at least one radio transmitter device at a wayside location that is not onboard any vehicle, wherein the RF signal includes location data associated with a location of the at least one radio transmitter device;

determine the location of the at least one radio transmitter device based on the location data included in the RF signal; and determine a location of a rail vehicle based on the location of the at least one radio transmitter device.

2. The system of claim 1, wherein the at least one processor is located on the rail vehicle.

3. The system of claim 1, wherein, when determining the location of the at least one radio transmitter device, the at least one processor is programmed or configured to:

determine the location of the at least one radio transmitter device based on determining that one or more satellite-based positioning system signals transmitted by one or more satellites of a satellite-based positioning system are unavailable.

4. The system of claim 3, wherein the at least one processor is further programmed or configured to:

determine that the one or more satellite-based positioning system signals transmitted by the one or more satellites of the satellite-based positioning system are unavailable based on comparing the one or more satellite-based positioning system signals to a threshold for a signal of a satellite-based positioning system and determining that the one or more satellite-based positioning system signals do not satisfy the threshold for a signal of a satellite-based positioning system.

5. The system of claim 1, wherein, when determining the location of the at least one radio transmitter device, the at least one processor is programmed or configured to:

determine the location of the at least one radio transmitter device based on the location data associated with the location of the at least one radio transmitter device included in the RF signal independent of data associated with satellite-based positioning system coordinates of the rail vehicle.

6. The system of claim 1, wherein the at least one processor is further programmed or configured to:

determine that the RF signal transmitted by the at least one radio transmitter device is available based on comparing the RF signal to a threshold for an RF signal and determining that the RF signal satisfies the threshold for an RF signal; and wherein, when determining the location of the at least one radio transmitter device, the at least one processor is programmed or configured to:

determine the location of the at least one radio transmitter device based on determining that the RF signal satisfies the threshold for an RF signal.

7. The system of claim 1, wherein, when receiving the RF signal transmitted by the at least one radio transmitter device, the at least one processor is programmed or configured to:

receive the RF signal transmitted by the at least one radio transmitter device based on a receiver device of the rail vehicle connecting to a communication network provided by the at least one radio transmitter device.

8. A method comprising:

receiving, with at least one processor, a radio frequency (RF) signal transmitted by at least one radio transmitter device that is at a wayside location and not onboard any vehicle, wherein the RF signal includes location data associated with a location of the at least one radio transmitter device;

determining, with the at least one processor, the location of the at least one radio transmitter device based on the location data included in the RF signal; and determining, with the at least one processor, a location of a rail vehicle based on the location of the at least one radio transmitter device.

9. The method of claim 8, wherein the at least one processor is located on the rail vehicle.

10. The method of claim 8, wherein determining the location of the at least one radio transmitter device comprises:

determining the location of the at least one radio transmitter device based on determining that one or more satellite-based positioning system signals transmitted by one or more satellites of a satellite-based positioning system are unavailable.

11. The method of claim 10, wherein determining the location of the at least one radio transmitter device comprises:

determining the location of the at least one radio transmitter device based on the location data associated with the location of the at least one radio transmitter device included in the RF signal independent of data associated with satellite-based positioning system coordinates of the rail vehicle.

12. The method of claim 10, further comprising:

determining that the one or more satellite-based positioning system signals transmitted by the satellite-based positioning system satellite are unavailable based on comparing the one or more satellite-based positioning system signals to a threshold for a satellite-based positioning system signal and determining that the one or more satellite-based positioning system signals do not satisfy the threshold for a satellite-based positioning system signal.

13. The method of claim 8, wherein the at least one processor is further programmed or configured to:

determine that the RF signal transmitted by the at least one radio transmitter device is available based on comparing the RF signal to a threshold for an RF signal and determining that the RF signal satisfies the threshold for an RF signal; and wherein, when determining the location of the at least one radio transmitter device, the at least one processor is programmed or configured to:

determine the location of the at least one radio transmitter device based on determining that the RF signal satisfies the threshold for an RF signal.

14. The method of claim 8, wherein receiving the RF signal transmitted by the at least one radio transmitter device comprises:

receiving the RF signal transmitted by the at least one radio transmitter device based on a receiver device of the rail vehicle connecting to a communication network provided by the at least one radio transmitter device.

15. A computer program product for determining a location of a rail vehicle based on a radio frequency (RF) signal, the computer program product comprising at least one non-transitory computer-readable medium including one or more instructions that, when executed by at least one processor, cause the at least one processor to:

receive an RF signal transmitted by at least one radio transmitter device at a wayside location that is not onboard any vehicle, wherein the RF signal includes location data associated with a location of the at least one radio transmitter device;

determine the location of the at least one radio transmitter device based on the location data included in the RF signal; and determine a location of a rail vehicle based on the location of the at least one radio transmitter device.

16. The computer program product of claim 15, wherein the one or more instructions that cause the at least one processor to determine the location of the at least one radio transmitter device, cause the at least one processor to:

determine the location of the at least one radio transmitter device based on determining that one or more satellite-based positioning system signals transmitted by one or more satellites of a satellite-based positioning system are unavailable.

17. The computer program product of claim 16, wherein the one or more instructions that cause the at least one processor to determine the location of the at least one radio transmitter device, cause the at least one processor to:

determine the location of the at least one radio transmitter device based on the location data associated with the location of the at least one radio transmitter device included in the RF signal independent of data associated with satellite-based positioning system coordinates of the rail vehicle.

18. The computer program product of claim 16, wherein the one or more instructions further cause the at least one processor to:

determine that the one or more satellite-based positioning system signals transmitted by the one or more satellites of the satellite-based positioning system are unavailable based on comparing the one or more satellite-based positioning system signals to a threshold for a satellite-based positioning system signal and determining that the one or more satellite-based positioning system signals do not satisfy the threshold for a satellite-based positioning system signal.

19. The computer program product of claim 16, wherein the one or more instructions further cause the at least one processor to:

determine that the RF signal transmitted by the at least one radio transmitter device is available based on comparing the RF signal to a threshold for an RF signal and determining that the RF signal satisfies the threshold for an RF signal; and wherein, the one or more instructions that cause the at least one processor to determine the location of the at least one radio transmitter device, cause the at least one processor to:

determine the location of the at least one radio transmitter device based on determining that the RF signal satisfies the threshold for an RF signal.

20. The computer program product of claim 16, wherein the one or more instructions that cause the at least one processor to receive the RF signal transmitted by the at least one radio transmitter device, cause the at least one processor to:

receive the RF signal transmitted by the at least one radio transmitter device based on a receiver device of the rail vehicle connecting to a communication network provided by the at least one radio transmitter device.

* * * * *